US005099287A

United States Patent [19]

Sato

[11] Patent Number: 5,099,287

[45] Date of Patent: Mar. 24, 1992

[54] TRANSFERRING VOLTAGE CONTROL SECTION

[75] Inventor: Kazunobu Sato, Shizuoka, Japan

[73] Assignee: Tokyo Electric Co., Ltd., Tokyo, Japan

[21] Appl. No.: 255,726

[22] Filed: Oct. 7, 1988

[30] Foreign Application Priority Data

Oct. 12, 1987 [JP] Japan ..... 62-254680

[51] Int. Cl.[5] ..... G03G 15/16

[52] U.S. Cl. ..... 355/274; 355/208; 355/311

[58] Field of Search ..... 355/271, 273, 274, 311, 355/208; 346/153.1, 160

[56] References Cited

U.S. PATENT DOCUMENTS

| | | | |
|---|---|---|---|
| 3,996,466 | 12/1976 | Davis | 355/274 X |
| 4,039,257 | 8/1977 | Connolly | 355/273 |
| 4,055,380 | 10/1977 | Borostyan | 355/273 |
| 4,373,801 | 2/1983 | Itoh | 355/208 X |
| 4,401,383 | 8/1983 | Suzuki et al. | 355/273 X |
| 4,766,467 | 8/1988 | Yamada et al. | 271/3.1 X |
| 4,772,918 | 9/1988 | Karasawa et al. | 355/274 |
| 4,774,593 | 9/1988 | Deguchi et al. | 358/301 |
| 4,789,878 | 12/1988 | Endo et al. | 355/271 |

FOREIGN PATENT DOCUMENTS

| | | | |
|---|---|---|---|
| 0120061 | 9/1980 | Japan | 355/274 |
| 136070 | 6/1988 | Japan | 355/274 |

*Primary Examiner*—A. T. Grimley
*Assistant Examiner*—Thu Anh Dang
*Attorney, Agent, or Firm*—Frishauf, Holtz, Goodman & Woodward

[57] ABSTRACT

An electrophotographic printing apparatus includes a paper supplying mechanism for supplying recording paper, and a transferring section for charging the recording paper supplied from the paper supplying mechanism by means of a transferring voltage and for transferring development material adhered to the surface of a charging body of the apparatus to the charged recording paper. The electrophotographic printing device further includes a transferring voltage control section for controlling the transferring voltage level according to the type of the recording paper.

7 Claims, 4 Drawing Sheets

| SW \ SIZE | A4 | B5 | LETTER | LEGAL | POST-CARD |
|---|---|---|---|---|---|
| CONTACT A,(17a) | ON | OFF | ON | OFF | ON |
| CONTACT B,(17b) | OFF | ON | OFF | ON | ON |
| CONTACT C,(17c) | OFF | OFF | ON | ON | ON |

TRANSFERRING VOLTAGE CONTROL SECTION

BACKGROUND OF THE INVENTION

1. Field of the Invention

This invention relates to an electrophotographic printing device, and more particularly to an electrophotographic printing device which can selectively print different types of recording papers.

2. Description of the Related Art

A laser printer is known as an electrophotographic printing device, for example. A typical laser printer includes a charging drum or photosensitive drum rotated in a predetermined direction at a preset speed, and a charging section, light exposure section, developing section, image transfer section, fixing section and charge removing section which are arranged around the peripheral portion of the charging drum and in the rotation direction thereof. In the printing process, the surface of the charging drum is electrostatically charged by means of the charging section, and then selectively exposed to a laser beam by means of the light exposing section. An electrostatic latent image (charge pattern) representing characters or patterns is formed on the surface of the charging drum by scanning the laser beam o the charged surface of the charging drum. After the formation of the electrostatic latent image, toner is supplied to the charging drum from the charging section and adhered to those portions of the surface of the charging drum which correspond to the electrostatic latent image, thus developing the electrostatic latent image. After the development, the toner image on the charging drum is transferred to a recording paper by means of the image transfer section. For example, the recording paper is supplied from a paper supply cassette and fed into between the charging drum and charging electrode so as to be set in contact with the toner on the charging drum and the charging electrode. The image transferring process is effected by applying a predetermined image transferring D.C. voltage between the charging drum and the charging electrode under this condition and then separating the recording paper from the charging drum. The surface of the recording paper is charged with the same polarity as the surface of the charging drum by the image transferring D.C. voltage. When the recording paper is separated from the charging drum, the toner on the charging drum is attracted by means of electrostatic forces and adhered to the recording paper. After the image transferring process, the electrostatic charges on the surface of the charging drum are removed by means of the charge removing section, and heat and pressure are applied to the recording paper by means of the fixing section. As a result of the fixing process, the toner image on the recording paper is fixed on the recording paper. After this, the recording paper is discharged from the printer to the outside.

In general, a conventional electrophotographic printing device is so constructed as to selectively supply different types of recording papers. In most cases, a plurality of paper supply cassettes are provided for recording papers of different sizes, for example, A4, B5 and letter sizes, and the recording papers of the different sizes are received in the respective paper supply cassettes. The operator selects a paper supply cassette having recording papers of a desired size received therein and sets the cassette in the electrophotographic printing device prior to the printing process.

Recently, an electrophotographic printing device which can selectively supply sheet of recording paper of postcard size relatively smaller than the conventional paper size has been developed. However, in a case where the postcard is actually used as a recording paper, the printing quality will be deteriorated by an insufficient image transferring process. The insufficient image transferring process is caused by the thickness of the postcard which is larger than that of the standard recording paper for the electrophotographic printing device. In this case, it is difficult to sufficiently charge the surface of the postcard by the image transferring voltage. Further, the insufficient image transferring process may be caused by the quality of the postcard.

SUMMARY OF THE INVENTION

An object of this invention is to provide an electrophotographic printing device which can attain high printing quality irrespective of the type of recording paper.

This object can be attained by an electrophotographic printing device which comprises a charging body; an electrostatic latent image formation section for forming an electrostatic latent image on the surface of the charging body; a developing section for supplying development material to be adhered to the surface of the charging body in position defined by the electrostatic latent image; a paper supplying mechanism for supplying recording paper; a transferring section for charging the recording paper supplied from the paper supplying mechanism by means of a transferring voltage and transferring the visible image formed of the development material adhered to the surface of the charging body to the charged recording paper; and a transferring voltage control section for controlling the transferring voltage level according to the type of the recording paper.

With the electrophotographic printing device, the transferring voltage can be set to a high voltage level when a thick recording paper is used, for example, so that the recording paper can be sufficiently charged to effect a stable image transferring process. Thus, the printing quality can be prevented from being deteriorated according to the types of the recording papers.

DETAILED DESCRIPTION OF THE PREFERRED EMBODIMENTS

There will now be described a laser printer according to one embodiment of this invention with reference to FIGS. 1 to 5.

Figure 1:
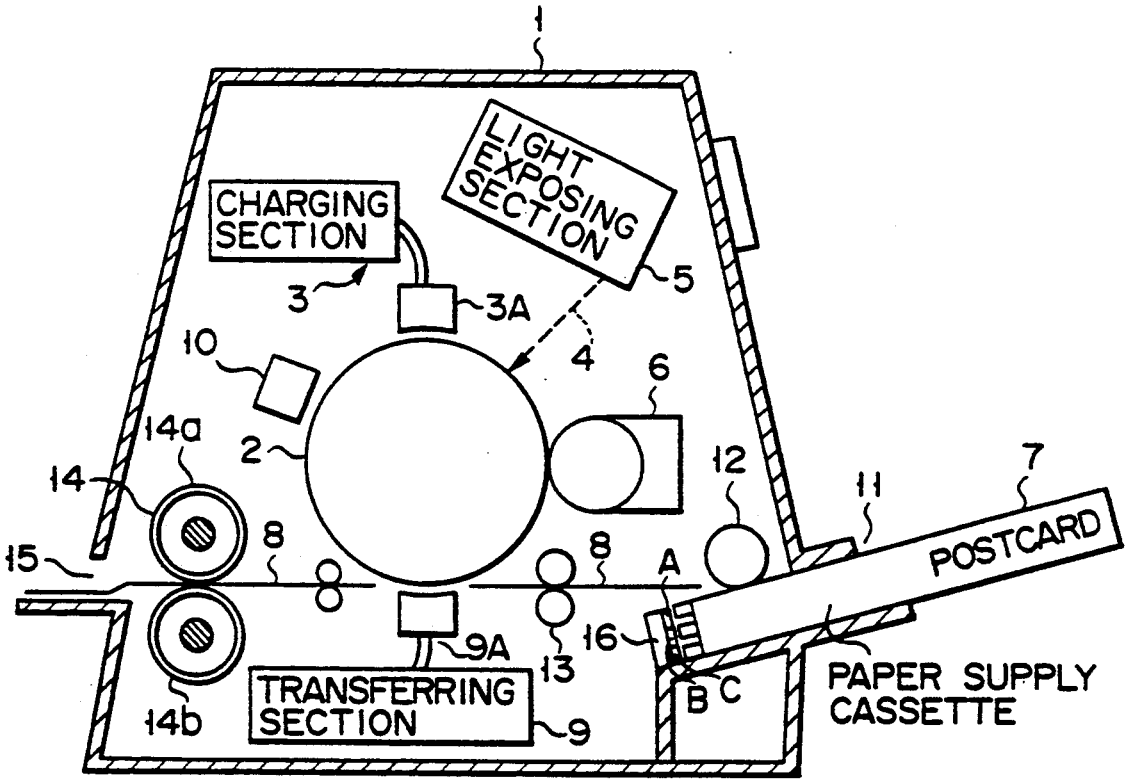
FIG. 1 is a diagram showing the internal structure of a laser printer according to one embodiment of this invention.

FIG. 1 is a diagram showing the internal structure of the laser printer. The laser printer includes casing 1 and charging drum 2 placed in substantially the central area of casing 1. The outer surface of charging drum or photosensitive drum 2 is used as a photosensitive surface. Charging drum 2 is rotated in a clockwise direction at a constant speed. As in the conventional case, the laser printer includes charging section 3 having charger 3A for electrostatically charging the charging drum, light exposing section 5 for applying laser beam 4 to the surface of charging drum 2 in response to an image signal, developing section 6 for supplying toner which will be adhered to the surface of the charging drum in position defined by the electrostatic latent image formed on charging drum 2 by the laser beam, image transferring section 9 having transfer charger 9A for transferring the image forming toner adhered to the surface of the charging drum to recording paper 8, and charge removing section 10 having a charge removing lamp for removing residual charges on the surface of charging drum 2 after the image transferring process. Charging section 3, light exposing section 5, developing section 6, image transferring section 9 and charge removing section 10 are arranged around charging drum 2.

Further, the laser printer includes cassette receiving slot 11 into which paper supply cassette 7 can be removably set. A plurality of sheets of recording paper 8 are set in paper supply cassette 7. Sheets of recording paper 8 are drawn out of paper supply cassette 7 one by one by means of CF roller 12 and fed to transferring section 9 via carriage roller 13. Recording paper 8 is subjected to the image transferring process in image transferring section 9, fed through between a pair of fixing rollers 14*a* and 14*b* provided in fixing section 14, and then discharged via paper discharging slot 15 to the exterior of casing 1.

The laser printer further includes microswitch 16 having three contacts A, B and C which are selectively activated to detect the type of paper 8 when paper supply cassette 7 is set via cassette receiving slot 11.

Figure 2:
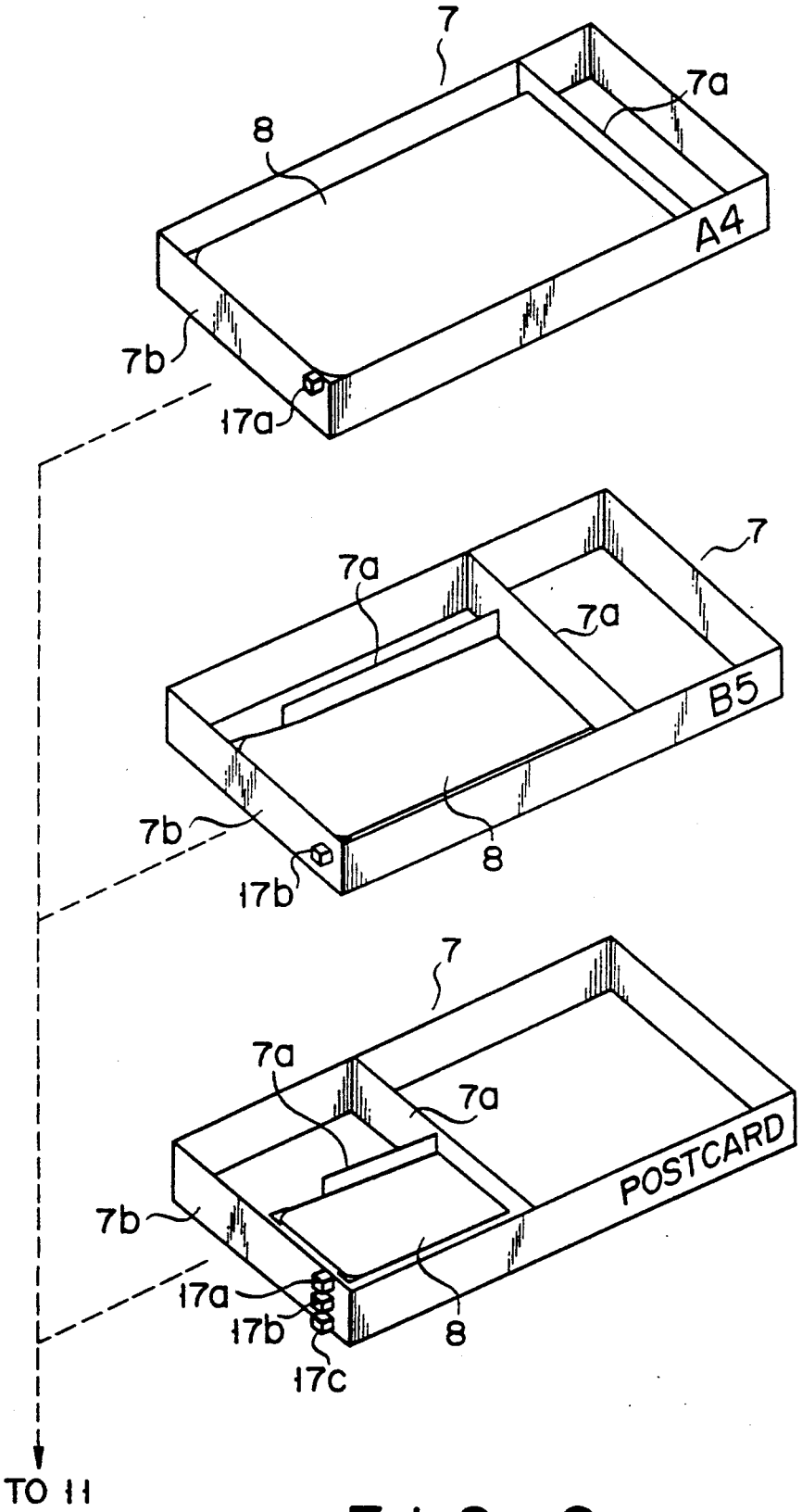
FIG. 2 is a perspective view of examples of a paper supply cassette to be selectively installed on the laser printer shown in FIG. 1.

FIG. 2 is a perspective view of examples of paper supply cassette 7 to be inserted into cassette receiving slot 11. Each of paper supply cassettes 7 is used for receiving sheets of recording paper of a specified size.

In the laser printer described above, five types of paper supply cassettes 7 are provided for respective types of recording paper used in the printing process. In each of paper supply cassettes 7, partition plates 7*a* are used to hold the recording paper in a preset position. Projections 17*a* to 17*c* are selectively formed on front surface 7*b* of paper supply cassette 7 in order to respectively activate contacts A, B and C of microswitch 16. Since eight different combinations of three projections 17*a* to 17*c* can be attained, eight types of paper supply cassettes 7 can be selectively specified. In FIG. 2, projections 17*a* to 17*c* are formed on paper supply cassette 7 exclusively used for postcards, projection 17*a* is formed on paper supply cassette 7 exclusively used for A4-size paper, and projection 17*b* is formed on paper supply cassette 7 exclusively used for B5-size paper.

Figures 3, 4:
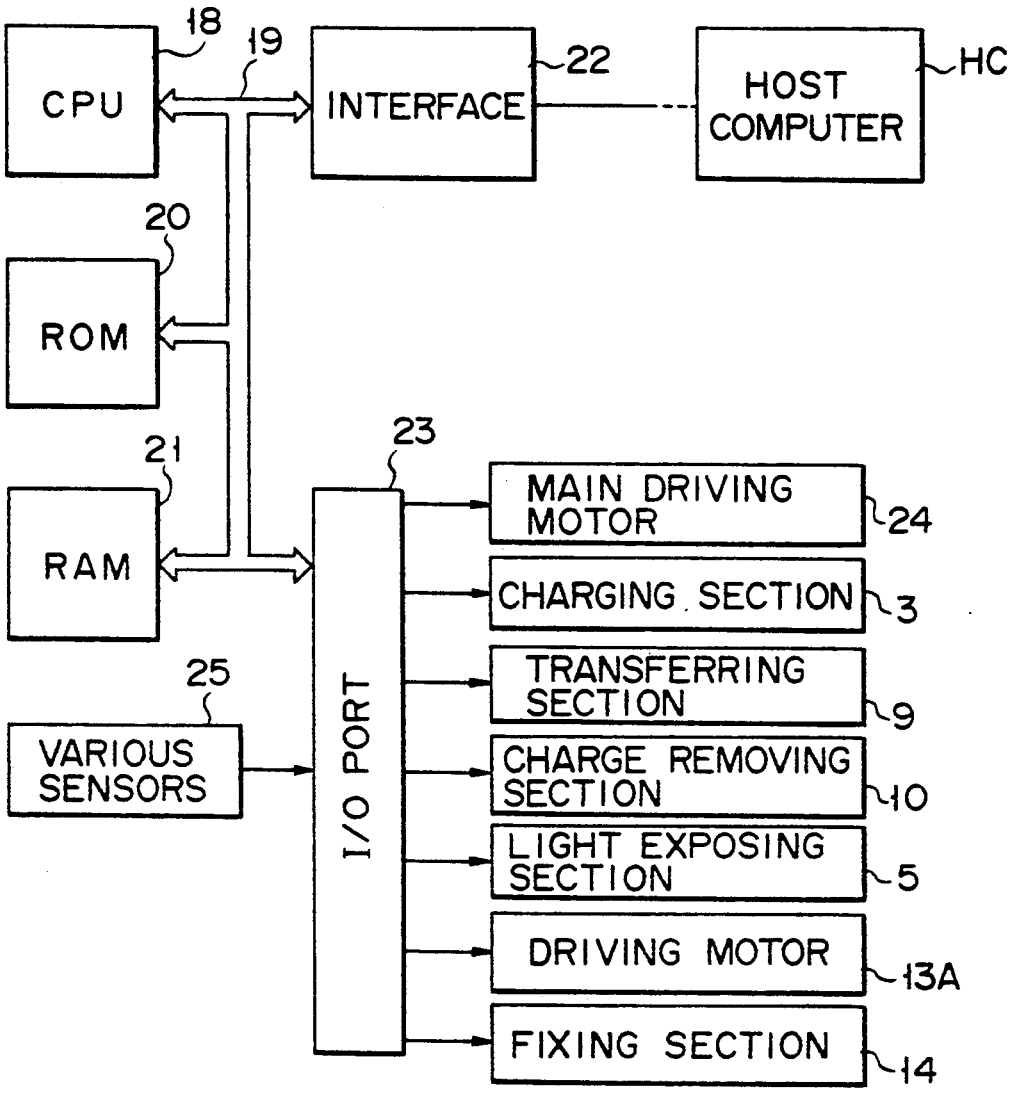
FIG. 3 is a circuit diagram showing a control circuit of the laser printer shown in FIG. 1.
FIG. 4 shows the relation between the types of recording papers to be used in the laser printer shown in FIG. 1 and the contact positions of microswitches.

FIG. 3 is a block diagram showing the control circuit of the laser printer. The laser printer includes central processing unit (CPU) 18 for performing various operations, ROM 20 for storing fixed data such as control program, RAM 21 for storing variable data such as input character data, interface 22 connected to receive character data to be printed and supplied from external host computer HC, and input/output (I/O) port 23 via which various instructions and data are input and output. The above circuit elements are connected to each other via bus line 19. I/O port 23 is further connected to main driving motor 24 for driving charging drum 2, charging section 3, transferring section 9, charge removing section 10, light exposing section 5, driving motors 13A for driving CF roller 12 and carriage roller 13, various sensors 25 and fixing section 14.

Transferring section 9 is connected to microswitch 16 having three contacts A, B and C for detecting the type of paper supply cassette 7 or paper 8 to be supplied.

FIG. 4 shows the relation between the conditions of contacts A, B and C and the types of paper 8 to be detected in the laser printer.

Figure 5:
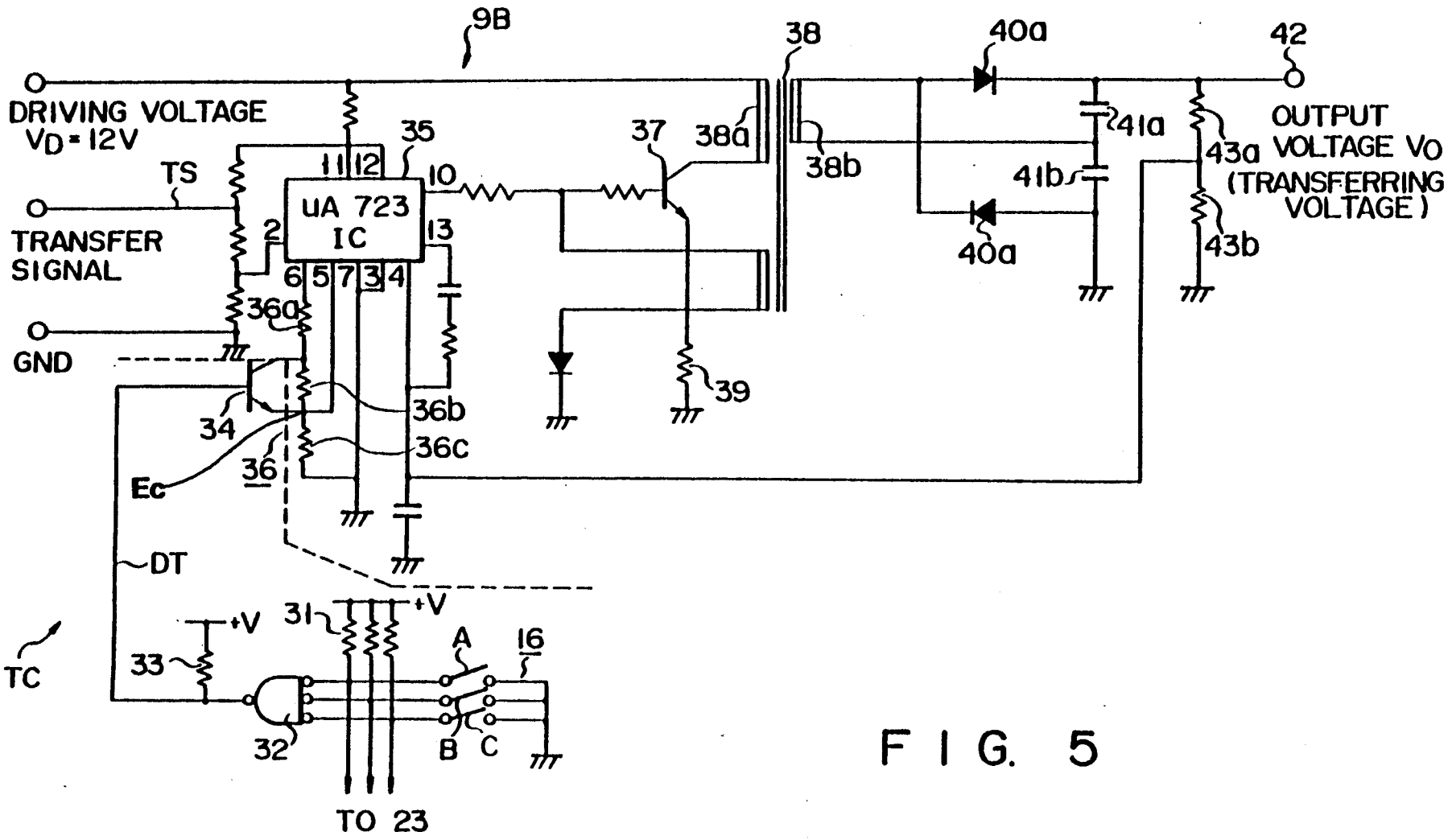
FIG. 5 is a circuit diagram showing the image transferring section shown in FIG. 3, more in detail.

FIG. 5 shows the transferring section 9 more in detail. Transferring section 9 includes transferring voltage generating circuit 9B and transferring voltage controlling circuit TC. Circuit 9B is a type of switching regulator using a voltage regulator IC (μA723) which is well known in the art as shown in FIG. 5. In transferring voltage controlling circuit TC, one end of each contacts A, B and C of microswitch 16 mounted in cassette receiving slot 11 is grounded, and the other ends of respective contacts A, B and C are connected to power source voltage terminal +V via pull-up resistors 31 and to the respective negative logic input terminals of NAND gate 32. An output terminal of NAND gate 32 is connected to power source voltage terminal +V via resistor 33 and to the base of npn transistor 34. In this way, NAND gate 32 generates postcard detection signal DT of "L" level to turn off transistor 34 when paper supply cassette 7 for postcard is inserted into cassette receiving slot 11 and contacts A, B and C are all detected to be closed.

Transferring voltage generating circuit 9B includes voltage setting circuit 36 formed of three resistors 36*a*, 36*b* and 36*c* connected in series between constant voltage terminal ⑥ of voltage regulator IC 35 and the ground. The voltage at the connection node between resistors 36*b* and 36*c* of voltage setting circuit 36 is supplied as preset voltage Ec to voltage input terminal ⑤ of the voltage regulator IC. Further, both ends of resistor 36*b* of voltage setting circuit 36 are connected to the collector and emitter of transistor 34. Unless postcard detection signal DT is generated, transistor 34 is kept in the conductive state, setting preset voltage Ec to a voltage level E1 obtained by dividing the constant voltage based on the resistance ratio of resistors 36*a* and 36*c*. When transistor 34 is turned off by postcard detection signal DT, preset voltage Ec is set a to voltage level E2 obtained by dividing the constant voltage based on the ratio of the sum of resistances of two resistors 36*a* and 36*b* and the resistance of resistor 36*c*.

The operation of voltage regulator IC 35 is started in response to the fall of transfer signal TS supplied for transfer control from CPU 18, and a switching signal of a preset frequency having a duty ratio corresponding to preset voltage Ec is supplied from IC 35 to the base of transistor 37. The collector of transistor 37 is connected to one end of primary winding 38*a* of high-voltage transformer 38 and the emitter thereof is grounded via resistor 39. The other end of primary winding 38*a* of high-voltage transformer 38 is connected to a driving voltage terminal of D.C. 12 V.

Secondary winding 38*b* of high voltage transformer 38 is connected to output terminal 42 via rectifying diodes 40*a*, 40*c* and smoothing capacitors 41*a* and 41*b*.

Output voltage Vo is supplied as a transfer voltage from output terminal 42 to transfer charger 9A. Output voltage Vo is divided based on the resistance ratio of voltage dividing resistors 43*a* and 43*b* and then fed back to voltage regulator IC 35.

When preset voltage Ec of voltage setting circuit 36 in E1, output voltage Vo is set to 5.0 KV which is an optimum transfer voltage for transferring an image to ordinary paper of A4, B5 and letter sizes, for example. When preset voltage Ec is E2, output voltage Vo is set to 5.3 KV which is an optimum transfer voltage for transferring an image to a postcard, for example. The turns ratio of high-voltage transformer 38 and the resistance of each resistor of voltage setting circuit 36 are so determined as to attain the above transfer voltages.

Next, the operation of transfer voltage controlling circuit TC for controlling the transfer voltage to be applied to transfer charger 9A is explained. When the power source of the printer is turned on, each section including fixing section 14 is set into an operable condition. Assume now that paper supply cassette 7 for recording paper of A4, B5 or letter size other than the postcard size is set into cassette receiving slot 11. In this case, one of contacts A, B and C of microswitch 16 is kept open, causing an output signal of NAND gate 32 to be set to an "H" level. At this time, transistor 34 is kept conductive to set preset voltage Ec of voltage setting circuit 36 to voltage level E1.

Under this condition, paper 8 is supplied from paper supply cassette 7 to transfer section 9 and then brought into contact with the toner image formed on the surface of charging drum 2. Then, transfer signal TS is set to an "L" level, permitting voltage regulator IC 35 to operate. At this time, D.C. voltage Vo of 5.0 KV is supplied from output terminal 42. Output voltage Vo is supplied as a transfer voltage to transfer charger 9A. As a result, the toner image on charging drum 2 is transferred onto paper 8 used as ordinary paper. Then, paper (ordinary paper) 8 to which the toner image is thus transferred is fed to fixing section 14.

Next, the operation of printing the postcard is explained.

In this case, paper supply cassette 7 for the postcard is set into cassette receiving slot 11. Then, contacts A, B and C of microswitch 16 are all closed or turned on. As a result, postcard detection signal DT of "L" level is generated from NAND gate 32 to turn off transistor 34. At this time, preset voltage Ec of voltage setting circuit 36 is set to a voltage level E2. After this, when transfer signal TS is set to "L" level, voltage regulator IC 35 is operated. In this case, D.C. voltage Vo of 5.3 KV is generated from output terminal 42, and is applied to transfer charger 9A as a transfer voltage. As a result, the toner image on charging drum 2 is transferred onto the postcard. Then, paper (postcard) 8 to which the toner image is transferred is fed to fixing section 14.

In this way, the toner image is transferred with transfer voltage Vo of 5.0 KV when ordinary paper of A4, B5 and letter sizes is used as recording paper 8, and the toner image is transferred with transfer voltage Vo of 5.3 KV when thick paper such as a postcard is used as recording paper 8.

Transfer voltage controlling circuit TC can automatically raise the transfer voltage in a case where the thickness of recording paper is changed from the standard thickness of paper (ordinary paper) of A4, B5 and letter sizes to the thickness of the postcard which is thicker than the ordinary paper. Therefore, it is possible to transfer the toner image to the ordinary paper and postcard under respective satisfactory conditions. In this way, high electrophotographic printing quality can be always obtained irrespective of the thickness and quality of the recording paper.

In the above embodiment, when paper supply cassette 7 is replaced, an optimum transfer voltage is automatically selected, and therefore it is not necessary for the operator to select the transfer voltage according to the type of recording paper. Thus, the laser printer is superior in its operability.

In the above embodiment, two transfer voltages are selectively set. However, in a case where it is required to select three or more transfer voltages, the number of resistors of voltage setting circuit 36 is increased and shunt transistors are respectively connected in parallel with selected resistors. In this case, the conduction states of the shunt transistors are selectively controlled by means of a decoder, for example, according to the contact positions of microswitch 16.

On the embodiment, charging drum 2 is used as charging body. However, it can be replaced by a charging belt having a photosensitive surface.

Further, I/O port 23 can be connected to microswitch 16 so as to detect that paper supply cassette 7 is not inserted into slot 11, for example.

What is claimed is:

1. An electrophotographic printing device, comprising:

a charging body;

image formation means for forming an electrostatic latent image on a surface of said charging body;

developing means for supplying development material to be adhered to the surface of said charging body in positions defined by the electrostatic latent image;

paper supplying means for supplying recording paper;

transferring means for charging the recording paper supplied from said paper supplying means by means of a transferring voltage, and for transferring a visible image formed of the development material adhered to the surface of said charging body into a charged recording paper; and voltage control means for controlling a level of said transferring voltage according to the type of the recording paper, said voltage control means including detecting means for detecting a type of the recording paper from an index portion of a paper supply cassette for storing the recording paper; and wherein said detecting means includes a plurality of switching elements which are selectively actuated by projections formed in said index portion of the paper supply cassette when the paper supply cassette is installed into said paper supplying means; and a gate circuit for detecting that said switching elements are actuated in a predetermined combination to generate a detection signal.

2. A device according to claim 1, wherein said voltage control means includes adjusting means for causing the level of the transferring voltage to be increased when the recording paper is detected to be a specific type by said detecting means.

3. A device according to claim 2, wherein said transferring means includes a voltage generating means for generating, as the transferring voltage, an output voltage in accordance with an input voltage; and said adjusting means includes a voltage dividing circuit having first and second resistive means connected in series between power terminals for generating an output voltage from a junction of said first and second resistive means as the input voltage of said voltage generating means, and switching means connected in parallel to part of said first resistive means, whose conduction state is controlled by the detection signal supplied from said gate circuit.

4. A device according to claim 2, wherein said specific type of the recording paper is thicker than the recording paper of a standard type.

5. A device according to claim 1, wherein said voltage control means includes adjusting means for causing the transferring voltage to be changed to a suitable level for the recording paper of the type detected by said detecting means.

6. An electrophotographic printing device, comprising:

a charging body;

image formation means for forming an electrostatic latent image on a surface of said charging body;

developing means for supplying development material to be adhered to the surface of said charging body in positions defined by the electrostatic latent image;

paper supplying means for supplying recording paper;

transferring means for charging the recording paper supplied from said paper supplying means by means of a transferring voltage, and for transferring a visible image formed of the development material adhered to the surface of said charging body into a charged recording paper; and voltage control means for controlling a level of said transferring voltage according to the type of the recording paper; and wherein said voltage control means includes:

detecting means for detecting a type of the recording paper from an index portion of a paper supply cassette for storing the recording paper, said detecting means including a plurality of switching elements which are selectively actuated by actuating elements formed in said index portion of said paper supply cassette when said paper supply cassette is installed into said paper supplying means, and a gate circuit for detecting that said switching elements are actuated in a predetermined combination to generate a detection signal.

7. A device according to claim 6, wherein said voltage control means includes adjusting means for causing the transferring voltage to be changed to a suitable level for the recording paper of the type detected by said detecting means.

* * * * *